US007140340B2

(12) United States Patent
Hashimoto

(10) Patent No.: US 7,140,340 B2
(45) Date of Patent: Nov. 28, 2006

(54) DECOMPRESSION DEVICE FOR ENGINE

(75) Inventor: Tamaki Hashimoto, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/951,886

(22) Filed: Sep. 29, 2004

(65) Prior Publication Data

US 2005/0066925 A1 Mar. 31, 2005

(30) Foreign Application Priority Data

Sep. 30, 2003 (JP) ..... 2003-341728

(51) Int. Cl.
*F01L 13/08* (2006.01)

(52) U.S. Cl. ..... 123/182.1

(58) Field of Classification Search ..... None
See application file for complete search history.

(56) References Cited

U.S. PATENT DOCUMENTS 5,184,586 A * 2/1993 Buchholz ..... 123/182.1
6,792,905 B1 * 9/2004 Ghelfi et al. ..... 123/182.1

FOREIGN PATENT DOCUMENTS

JP 6-58110 U 8/1994
JP 09-079017 A 3/1997

* cited by examiner

*Primary Examiner*—Andrew M. Dolinar
(74) *Attorney, Agent, or Firm*—Smith, Gambrell & Russell, LLP

(57) ABSTRACT

A return spring is constituted of a torsion spring, a spring part is held at a position different from that of a shaft part of a flyweight, and a free end portion of the return spring is hooked to a slide unit of the flyweight. The position of transmission of an urging force to be transmitted from the return spring to the flyweight is different between an angle-closing side and an extending and opening side. By tuning the shape of the slide unit, the position of protrusion of a spring fixing pivot, or the like, the distance from the shaft part to a contact point of the free end portion when the flyweight is located at the angle-closing position is set to be larger than the distance from the shaft part to the contact point of the free end portion when the flyweight is located at the extending and opening position.

17 Claims, 3 Drawing Sheets

DECOMPRESSION DEVICE FOR ENGINE

This application claims benefit of Japanese Application No. 2003-341728 filed on Sep. 30, 2003, the contents of which are incorporated by this reference.

BACKGROUND OF THE INVENTION

1. Field of the Invention

The present invention relates to a decompression device for an engine to reduce the compression pressure by opening at least one of an intake valve and an exhaust valve during the compression stroke at a low engine speed when the engine is started.

2. Description of the Related Art

A decompression device to reduce loads when starting the engine by opening at least one of the intake valve and the exhaust valve to maintain a combustion chamber in a half-compression state (a decompression state) to reduce the load when starting the engine has been known. A technology to release the decompression state by extending and opening a flyweight utilizing centrifugal force by rotation of a camshaft of the engine has been widely employed in decompression devices, and in these kinds of decompression devices, the flyweight must be urged to an angle-closing side by a predetermined urging force.

A return spring has been extensively employed to urge the flyweight to the angle-closing side, and in Japanese Unexamined Patent Application Publication No. 9-79017, a technology is disclosed in which the return spring constituted of a torsion spring is concentrically supported with a shaft part (a decompression cam) of the flyweight, thereby urging the flyweight to the angle-closing side by the urging force of the torsion spring. Furthermore, in Japanese Unexamined Utility Model Application Publication No. 6-58110, a technology is disclosed in which the return spring constituted of a coil spring is disposed in a gear part of the camshaft, and the flyweight is urged to the angle-closing side by the urging force of the coil spring.

In the decompression device, it is required that the flyweight is reliably turned to the extending and opening position at a predetermined engine speed forming the decompression release revolution speed, and the flyweight is reliably maintained at the angle-closing position when such as the engine is stopped. In this case, the moment provided to the flyweight by the urging force of the return spring is changed in a substantially linear manner as the engine speed is increased (in other words, the flyweight is extended and opened), and in order to simultaneously satisfy these requirements by the above technology, the spring constant of the return spring must be set to be small, and the tension provided to the return spring at the angle-closing position of the flyweight must be set high (refer to a two-dot-chain line in FIG. 3).

However, if the tension provided to the return spring at the angle-closing position of the flyweight is set to be high, the turning angle from the angle-closing position to the extending and opening position of the flyweight can be limited due to the characteristic of the return spring, and it is not preferable to continuously provide high tension to the return spring.

SUMMARY OF THE INVENTION

The present invention is achieved in light of the above situation, and an object of the present invention is to provide a decompression device for the engine capable of reliably and compatibly performing the operation of the flyweight on the angle-closing side and the extending and opening side without providing high tension to the return spring.

A decompression device for the engine of the present invention comprises a flyweight to be freely extended and opened by a centrifugal force caused by the rotation of the camshaft, a decompression cam to forcibly half-open at least one of the exhaust valve and the intake valve of the engine in an interlocking manner with a shaft part of the flyweight, and a return spring to urge the flyweight in the angle-closing direction by a predetermined urging force, wherein a slide unit is provided in the flyweight to allow the transmitting position of the urging force transmitted from the return spring to slide to the shaft part side as the flyweight is extended and opened.

DESCRIPTION OF THE PREFERRED EMBODIMENTS

Figure 2:
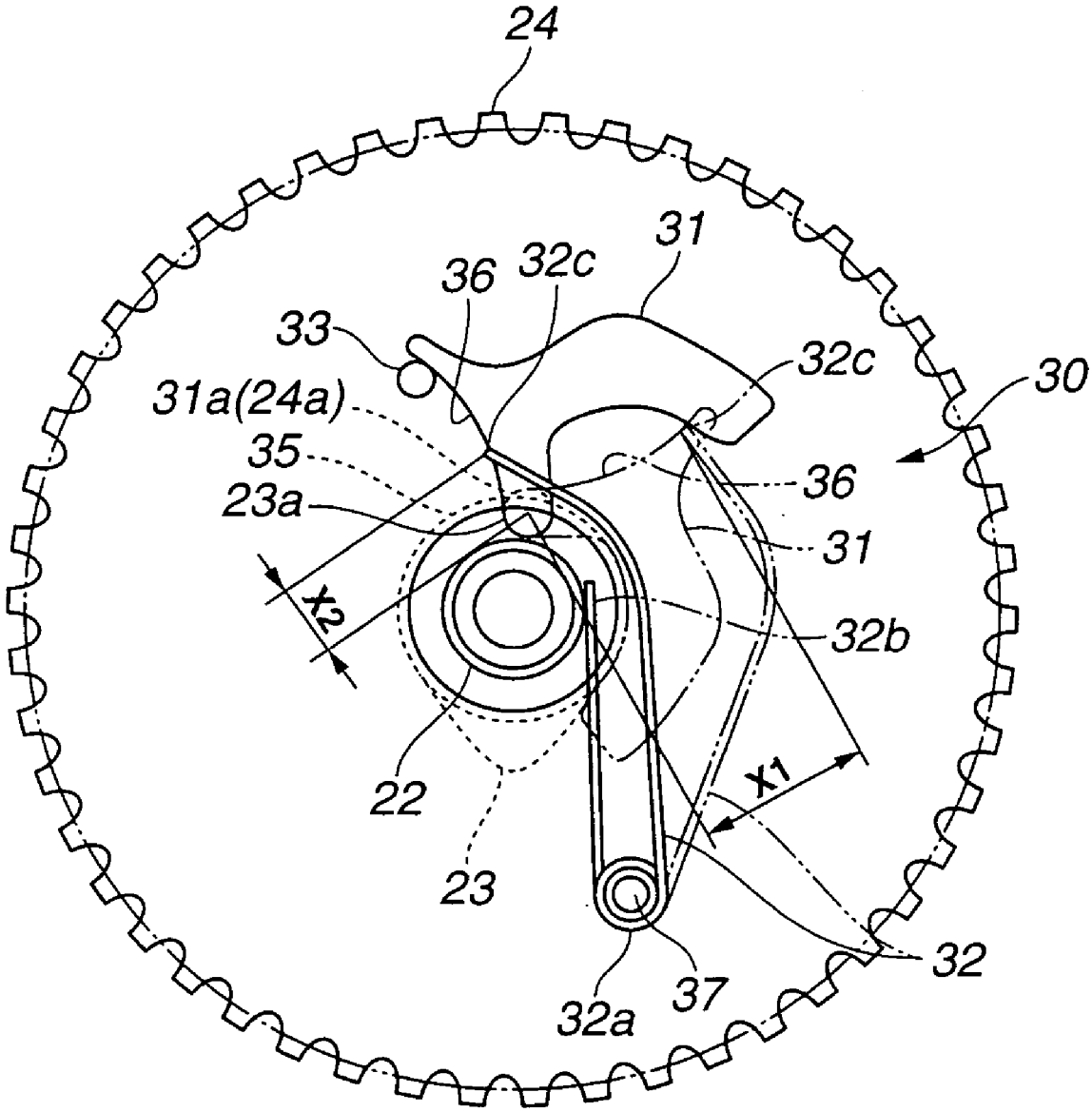
FIG. 2 is a front view of the decompression device.
Figure 3:
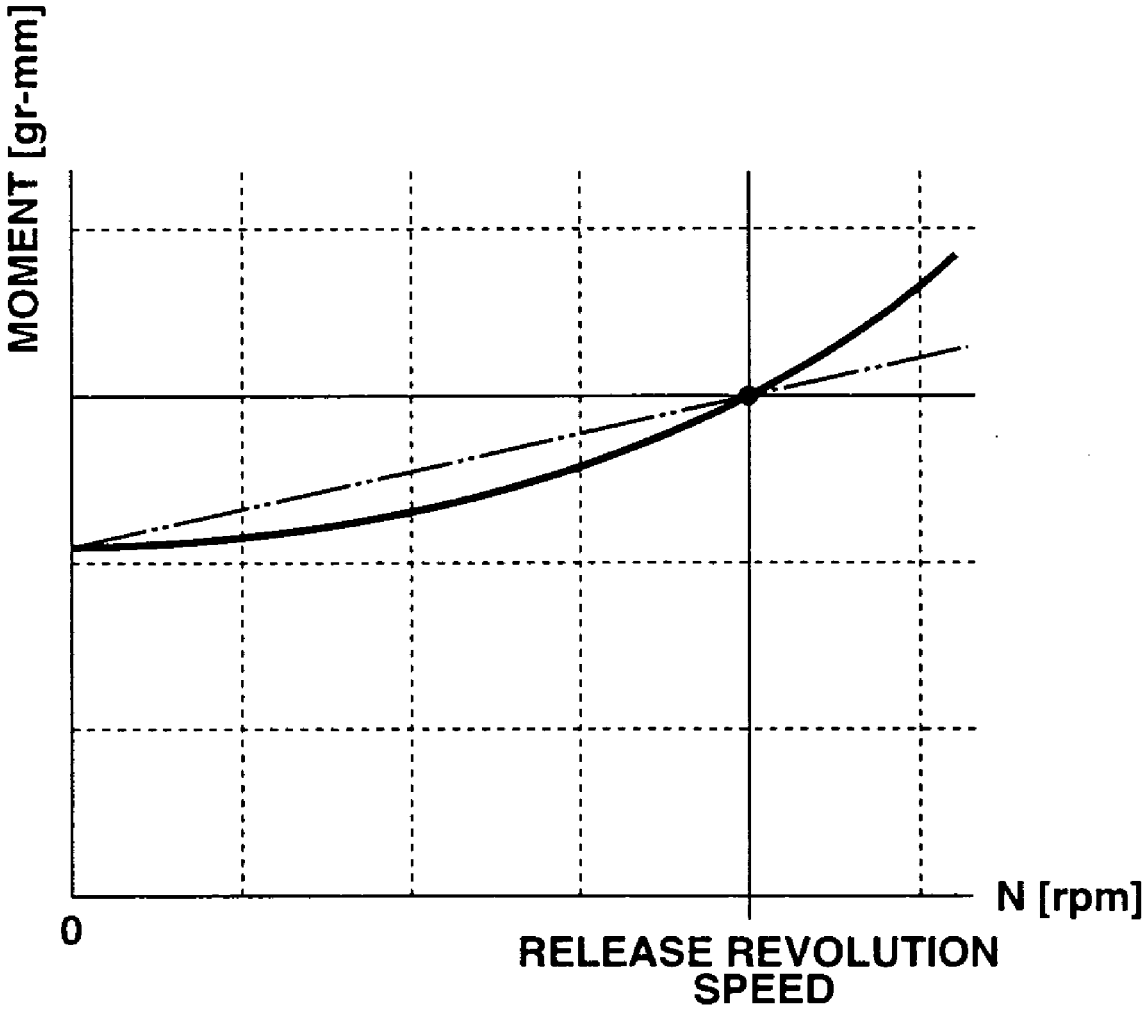
FIG. 3 is a characteristic chart to indicate the relationship between the engine speed and the moment provided to the flyweight.

An embodiment of the present invention will be described with reference to the drawings. The drawings are related to one embodiment of the present invention, and FIG. 1 is a schematic representation of a major part of the engine, FIG. 2 is a front view of the decompression device, and FIG. 3 is a characteristic chart to indicate the relationship between the engine speed and the moment provided to the flyweight.

Figure 1:
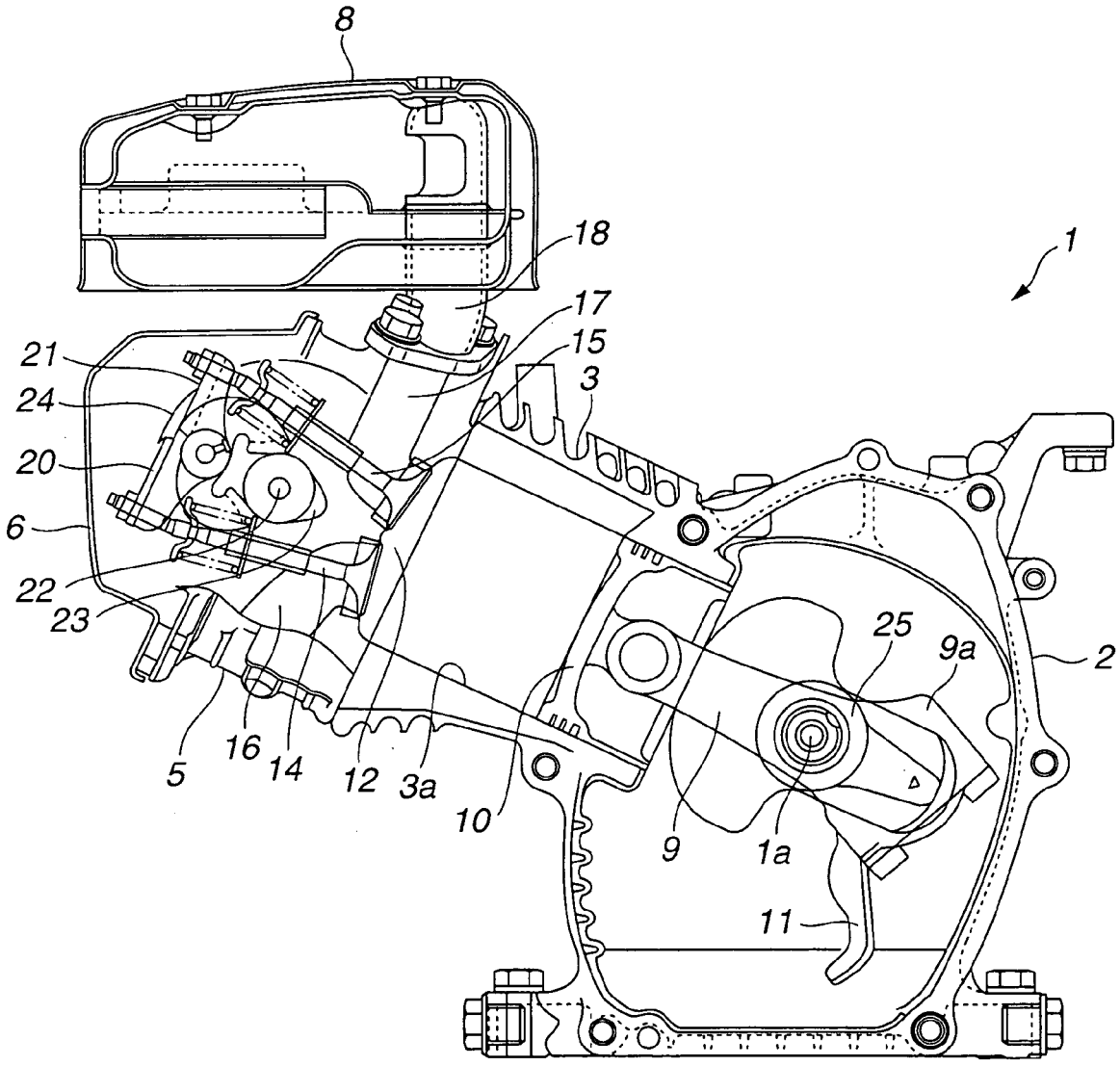
FIG. 1 is a schematic representation of a major part of the engine.

In FIG. 1, reference numeral 1 denotes a general purpose engine used for a prime mover of a generator, a working machine, a snow mobile or the like, and the engine is an SOHC engine in the figure. The overall height of the engine 1 is small because a cylinder block 3 integrated with a crankcase 2 is inclined. A cylinder head 5 is fixed to the cylinder block 3, and a rocker cover 6 is fixed to the cylinder head 5. In addition, a muffler 8 is disposed above the cylinder head 5 and the rocker cover 6.

A crankshaft 1*a* is turnably and pivotably supported by the crankcase 2. A piston 10 to be reciprocally driven in a cylinder 3*a* formed in the cylinder block 3 is connected to the crankshaft 1*a* via a connecting rod 9. Furthermore, an oil scraper 11 is fixed to a large end portion 9*a* of the connecting rod 9. And the connecting rod 9 is bolted around the crankshaft 1*a*.

A combustion chamber 12 demarcated by a bottom surface of the cylinder head 5 and a crown of the piston 10 is formed in the cylinder 3*a*. An intake valve 14 and an exhaust valve 15, and an ignition plug (not shown) face the combustion chamber 12. An intake port 16 opened/closed by the intake valve 14 and an exhaust port 17 opened/closed by the exhaust valve 15 are formed in the cylinder head 5. The intake port 16 opened in a lower portion of the cylinder head 5 communicates with an air cleaner (not shown), and an exhaust port 17 opened in an upper portion of the cylinder head 5 communicates with the muffler 8 via an exhaust pipe 18.

A rocker arm 20 for causing to push the intake valve 14 and a rocker arm 21 for causing to push the exhaust valve 15 are pivotably supported in the cylinder head 5 in a rocking manner. In addition, a camshaft 22 having a cam 23 brought into slidable contact with the rocker arms 20 and 21 is rotatably supported in the cylinder head 5. In addition, a driven sprocket 24 is integrally formed close to one end of the camshaft 22. A drive sprocket 25 fixed to the crankshaft 1*a* is provided to drive the driven sprocket 24 via a chain (not shown).

As shown in FIG. 2, a flyweight 31 to be opened/closed by the centrifugal force caused by the rotation of the camshaft 22 and a return spring 32 to urge the flyweight 31 in the angle-closing direction by a predetermined urging force are provided on one end face of the driven sprocket 24, to constitute a major part of a decompression device 30.

A shaft part 31*a* is protruded from a base portion of the flyweight 31. The shaft part 31*a* is passed through a bearing hole 24*a* formed in the driven sprocket 24 to pivotably support the flyweight 31. Thus, the flyweight 31 is rockable from an angle-closing position (shown by a two-dot-chain line in FIG. 2) in contact with the camshaft 22 to an extending and opening position (shown by a solid line in FIG. 2) in contact with a release lever stopper pin 33 protruding from the driven sprocket 24.

In addition, a decompression cam 35 is integrated with a tip portion of the shaft part 31*a*, and the decompression cam 35 is disposed in a notched portion 23*a* formed in the cam 23. The decompression cam 35 protrudes from the notched portion 23*a* when the flyweight 31 is located at the angle-closing position to forcibly half-open the intake valve 14 and the exhaust valve 15, and is evacuated in the notched portion 23*a* when the flyweight 31 is located at the extending and opening position.

A slide unit 36 to slidably hook the return spring 32 is formed on a side wall portion on the extending and opening side of the flyweight 31. In the present embodiment, the slide unit 36 is formed in a smoothly curved shape.

The return spring 32 is formed of a torsion spring, a spring part 32*a* of the annular torsion spring is held by a spring fixing pivot 37 protruding from the driven sprocket 24, and a fixed end portion 32*b* is hooked to the camshaft 22. Furthermore, a free end portion 32*c* of the return spring 32 is folded in the axial direction of the camshaft 22, and the folded free end portion 32*c* is hooked to the slide unit 36 of the flyweight 31 under a state of a predetermined tension. The flyweight 31 is urged in the angle-closing direction by hooking the free end portion 32*c* of the return spring 32.

In the decompression device 30 of the present embodiment, the return spring 32 is constituted by the torsion spring, the spring part 32*a* is held at a position different from that of the shaft part 31*a* of the flyweight 31, and the free end portion 32*c* of the return spring 32 is hooked to the slide unit 36 of the flyweight 31, the result being that the position of transmitting the urging force to be transmitted to the flyweight 31 from the return spring 32 is different between the angle-closing side and the extending and opening side.

In other words, in the decompression device 30, the free end portion 32*c* of the return spring 32 contacts the flyweight 31 in a rockable manner, and the distance from the shaft part 31*a* of the flyweight 31 to a point of action to the flyweight 31 by the free end portion 32*c* of the return spring 32 is changed according to the rocking of the flyweight 31 by differentiating the locus of the slide unit 36 from the locus of the free end portion 32*c* of the return spring 32 when the flyweight 31 is rocked.

In addition, in the above configuration, the distance X from the shaft part 31*a* to the free end portion 32*c* is set to be gradually reduced as the flyweight 31 is rocked in the extending and opening direction by tuning the shape of the slide unit 36, the position of protrusion of the spring fixing pivot 37, or the like.

In other words, by tuning the shape of the slide unit 36, the position of protrusion of the spring fixing pivot 37, or the like, a distance X is reduced from X1 to X2 when the flyweight 31 is rocked from the angle-closing position to the extending and opening position, and the position of transmission of the urging force to be transmitted from the return spring 32 to the flyweight 31 slides to the shaft part 31*a* side.

In this embodiment, a large moment can be provided to the flyweight 31 as shown by the solid line in FIG. 3 even when a small tension is provided to the return spring 32 by setting the distance X1 from the shaft part 31*a* to the free end portion 32*c* to be large when the flyweight 31 is located at the angle-closing position, as shown by the two-dot-chain line in FIG. 2. On the other hand, the tension in the return spring 32 is also increased as the flyweight 31 is moved in the extending and opening direction (as shown by the solid line in FIG. 2), and at the same time, the distance X from the shaft part 31*a* to the free end portion 32*c* is reduced. Therefore, the increase in the moment provided to the flyweight 31 by the urging force of the return spring 32 can be smoothly changed as shown by the solid line in FIG. 3.

As a result, correct holding of the flyweight 31 at the angle-closing position when the engine is stopped, and correct release of the decompression state at a predetermined engine speed (release revolution speed) can be reliably and compatibly realized without setting a high tension to be provided to the return spring 32 at the angle-closing position of the flyweight 31.

The characteristic of the moment provided to the flyweight 31 by the urging force of the return spring 32 can be adequately controlled in a step in which the flyweight 31 is rocked from the angle-closing position to the extending and opening position by forming the slide unit 36 in a predetermined curved shape.

In the present embodiment, the intake valve 14 and the exhaust valve 15 are forcibly half-opened when the engine is stopped or operated at a low speed by the decompression device 30. However, the embodiment is not limited thereto, and needless to say, the compression pressure is reduced by opening at least one of the intake valve and the exhaust valve during the compression stroke when the engine runs at a low speed.

Having described the preferred embodiments of the invention referring to the accompanying drawings, it should be understood that the present invention is not limited to those precise embodiments and various changes and modifications thereof could be made by one skilled in the art without departing from the spirit or scope of the invention as defined in the appended claims.

What is claimed is:

1. A decompression device for an engine comprising:

a flyweight to be freely extended by a centrifugal force caused by the rotation of a camshaft;

a decompression cam to forcibly open at least one of an exhaust valve and an intake valve of the engine in association with movement of a shaft part of the flyweight; and a return spring to urge the flyweight in the angle-closing direction by a predetermined urging force, wherein the flyweight has a slide unit to allow the position of transmission of a return spring urging force to slide toward the shaft part as the flyweight is moved by a centrifugal force; and the return spring having a free end portion that slidably contacts the slide unit is pivotably supported at a position different from that of the shaft part of the flyweight.

2. The decompression device for the engine according to claim 1, wherein the return spring is constituted of a torsion spring, the torsion spring is pivotably supported at a position different from that of the shaft part of the flyweight, the slide unit is constituted on a side wall portion of the flyweight, and a free end portion of the torsion spring slidably contacts the side wall portion.

3. The decompression device for the engine according to claim 2, wherein the side wall portion of the flyweight to constitute the slide unit is formed in a curved shape.

4. The decompression device for the engine according to claim wherein a side wall portion of the flyweight to constitute the slide unit is formed in a curved shape.

5. A decompression device for an engine comprising:

a flyweight to be freely extended by a centrifugal force caused by the rotation of a camshaft;

a decompression cam to forcibly open at least one of an exhaust valve and an intake valve of the engine in an interlocking manner with a shaft part of the flyweight; and a return spring to urge the flyweight in the angle-closing direction by a predetermined urging force, wherein the flyweight has a slide unit to allow the position of transmission of an urging force transmitted from the return spring to slide toward the shaft part as the flyweight is extended, and the return spring is pivotably supported at a position different from that of the shaft part of the flyweight, and the slide unit is constituted on a side wall portion of the flyweight, and a free end portion of the return spring slidably contacts the slide wall portion.

6. The decompression device for the engine according to claim 5, wherein the return spring is a torsion spring.

7. The decompression device for the engine according to claim 5, wherein a side wall portion of the flyweight to constitute the slide unit is formed in a curved shape.

8. The decompression device for the engine according to claim 1, wherein X1: represents the length from the shaft part to the position of the transmission of the urging force transmitted from the return spring when the flyweight is m a non-extended state; and X2: represents the length from the shaft part to the position of the transmission of the urging force transmitted from the return spring when the flyweight is extended by a centrifugal force;

wherein X1 is larger than X2.

9. The decompression device for the engine according to claim 3, wherein the curved shape is a concave shape.

10. The decompression device for the engine according to claim 1, wherein a moment provided to the flyweight by the urging force by the return spring changes according to the movement of the flyweight.

11. A decompression device for an engine comprising:

a flyweight to be freely moved by a centrifugal force caused by the rotation of a camshaft;

a decompression cam to open at least one of an exhaust valve and an intake valve of the engine in association with movement of the flyweight; and a return spring to urge the flyweight against the centrifugal force, and wherein the flyweight has a slide unit to allow a working point of an urging force by the return spring to slide as the flyweight is moved by the centrifugal force; and the return spring, having a free end portion that slidably contacts the slide unit. is pivotably supported at a position different from that of the shaft part of the flyweight.

12. The decompression device for the engine according to claim 11, wherein the return spring is a torsion spring.

13. The decompression device for the engine according to claim 11, wherein a side wall portion of the flyweight constituting the slide unit is formed in a curved shape.

14. The decompression device for the engine according to claim 13, wherein the curved shape is a concave shape.

15. The decompression device for the engine according to claim 11, wherein X1: represents the length from the shaft part to the position of the transmission of the urging force transmitted from the return spring when the flyweight is in a non-extended state; and X2: represents the length from the shaft part to the position of the transmission of the urging force transmitted from the return spring when the flyweight is extended by a centrifugal force;

wherein X1 is larger than X2.

16. The decompression device for the engine according to claim 11, wherein a moment provided to the flyweight by the urging force by the return spring varies in non-linear fashion relative to centrifugal force driven flyweight movement.

17. The decompression device for the engine according to claim 1, wherein a moment provided to the flyweight by the urging force by the return spring varies in non-linear fashion relative to centrifugal force driven flyweight extension.

* * * * *